US008607481B1

(12) United States Patent
Lukasko

(10) Patent No.: US 8,607,481 B1
(45) Date of Patent: Dec. 17, 2013

(54) PLOW BLADE ATTACHMENT

(76) Inventor: Alec Lukasko, Brookfield, OH (US)

( * ) Notice: Subject to any disclaimer, the term of this patent is extended or adjusted under 35 U.S.C. 154(b) by 0 days.

(21) Appl. No.: 13/374,735

(22) Filed: Jan. 11, 2012

Related U.S. Application Data

(60) Provisional application No. 61/462,137, filed on Jan. 31, 2011.

(51) Int. Cl.
*E01H 5/04* (2006.01)

(52) U.S. Cl.
USPC ..... 37/232; 37/266; 37/270

(58) Field of Classification Search
USPC ..... 37/270, 271, 232, 233, 266, 372; 172/817, 811
See application file for complete search history.

(56) References Cited

U.S. PATENT DOCUMENTS

| | | | | | |
|---|---|---|---|---|---|
| 2,864,184 | A | * | 12/1958 | Fohr | 37/404 |
| 4,125,950 | A | | 11/1978 | Mashford | |
| 4,521,980 | A | * | 6/1985 | Solaja | 37/404 |
| 4,905,387 | A | | 3/1990 | Street | |
| 5,097,609 | A | * | 3/1992 | Swaggert | 37/403 |
| 5,636,458 | A | * | 6/1997 | Drake | 37/270 |
| 5,775,012 | A | * | 7/1998 | Hockensmith | 37/270 |
| 6,240,662 | B1 | * | 6/2001 | Borowiak | 37/404 |
| 7,107,709 | B2 | | 9/2006 | Hamel | |
| 7,631,441 | B2 | | 12/2009 | Hunt | |
| 2005/0178029 | A1 | * | 8/2005 | Wightman | 37/232 |

* cited by examiner

*Primary Examiner* — Alicia Torres
(74) *Attorney, Agent, or Firm* — Harpman & Harpman

(57) ABSTRACT

An attachment for a plow blade and the like typically, used for removal of snow or in earth grading and moving. The attachment provides a contoured surface engagement element for the blade edge allowing it to ride over protruding surface obstacles without direct damaging engagement therewith. The attachment is selectively secured along the length of the blade edge by mounting brackets having quick release and mounted threaded frictional engagement elements.

5 Claims, 3 Drawing Sheets

PLOW BLADE ATTACHMENT

This application claims the benefit of Provisional Patent Application Ser. No. 61/462,137 filed Jan. 31, 2011.

BACKGROUND OF THE INVENTION

1. Technical Field

This device is directed to plows and specifically attachments for plows to isolate and reduce transit damage that occurs during use by contact with erratic irregular surface objects being plowed. Conventional plow systems are effective when plowing smooth surfaces, but are unsuited for uneven pavement and elevated edge surfaces that can damage the plow or conversely damage edge surfaces adjacent to the plowed surface.

2. Description of Prior Art

Prior art devices of this type have been developed to aid in the spacing of the blade edge from direct scraping contact with the surface during use, see for example U.S. Pat. Nos. 4,125,950, 4,905,387, 7,107,709, 7,631,441 and U.S. Publication 2005/0178029.

U.S. Pat. No. 4,125,950 discloses a snow plow attachment having a horizontal foot pivotally secured below the plow edge spacing the edge in relation to the contact surface.

U.S. Pat. No. 4,905,387 shows an adjustable wheel for a snow plow allowing the blade edge to be adjustably spaced from engagement with the surface to be plowed.

U.S. Pat. No. 7,107,709 claims an articulated scraper blade system wherein a plurality of independently mounted blades are attached to the blade edge allowing for selective independent linear movement to conform with irregular surface issues encountered.

Finally, in U.S. Patent Publication 2005/0178029 a blade attachment is shown having a split tubular body bolted over the leading edge of the plow blade thus providing a radius engagement to the edge.

SUMMARY OF THE INVENTION

An attachment for a plow blade that provides a non-aggressive radial engagement surface along the longitudinal plow edge. A tubular element is attached in edge alignment orientation to the plow by spaced brackets extending from within the tubular element extending from the radial surface.

DETAILED DESCRIPTION OF THE INVENTION

Figure 1:
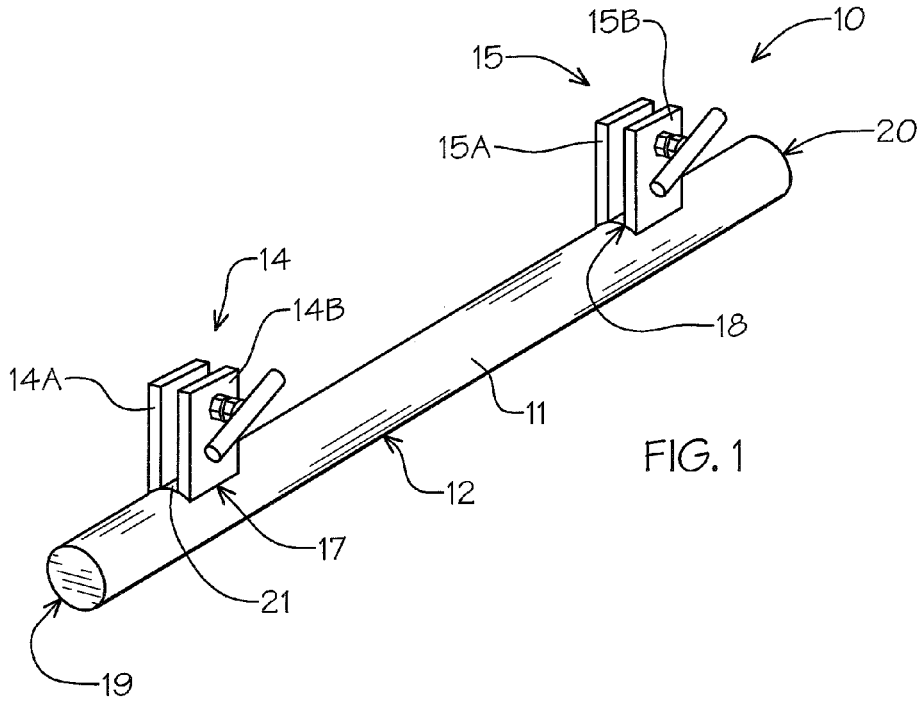
FIG. 1 is a perspective view of the blade attachment prior to installation.
Figure 4:
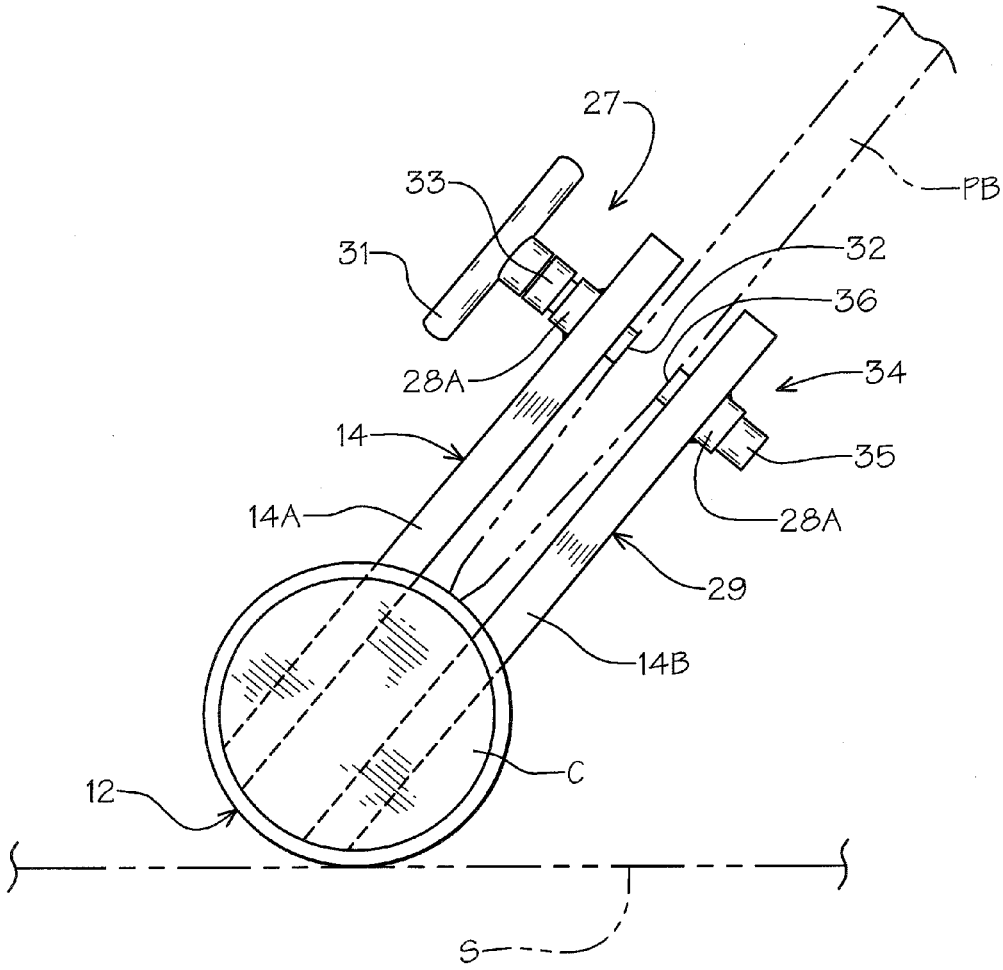
FIG. 4 is a side elevational graphic representation of the blade attachment positioned on a blade representation shown in broken lines engaging on a surface.

Referring to FIG. 1 of the drawings, a universal plow blade edge attachment 10 of the invention to prevent a plow blade PB edge impact with contact surfaces can be seen having a closed cylindrical main body member 11 of an exterior dimension determined by contoured surface engagement area 12 needed in comparison to surface use venues and overall blade size in the longitudinal length needed to engage the full length of the plow blade edge as seen in FIG. 4 of the drawings.

Pairs of longitudinally spaced aligned mounting and quick release attachment fittings 14 and 15 are affixed by welding W from within the cylinder body member 11 through equilateral openings at 17 and 18 in the contoured outer upper surface S thereof.

Figure 2:
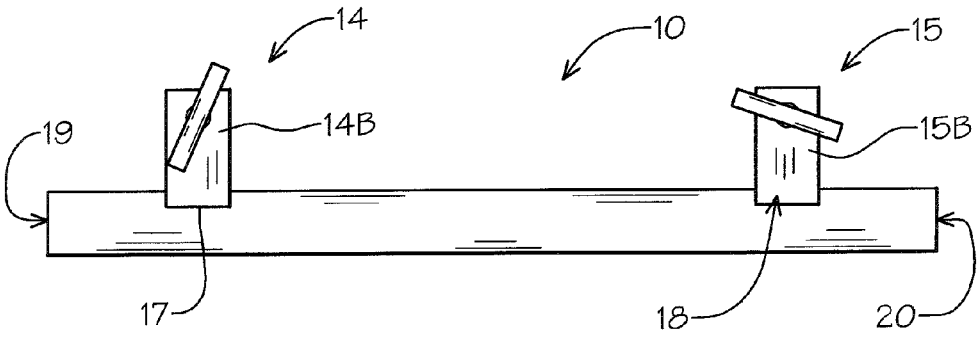
FIG. 2 is a front elevational view thereof.
Figure 3:
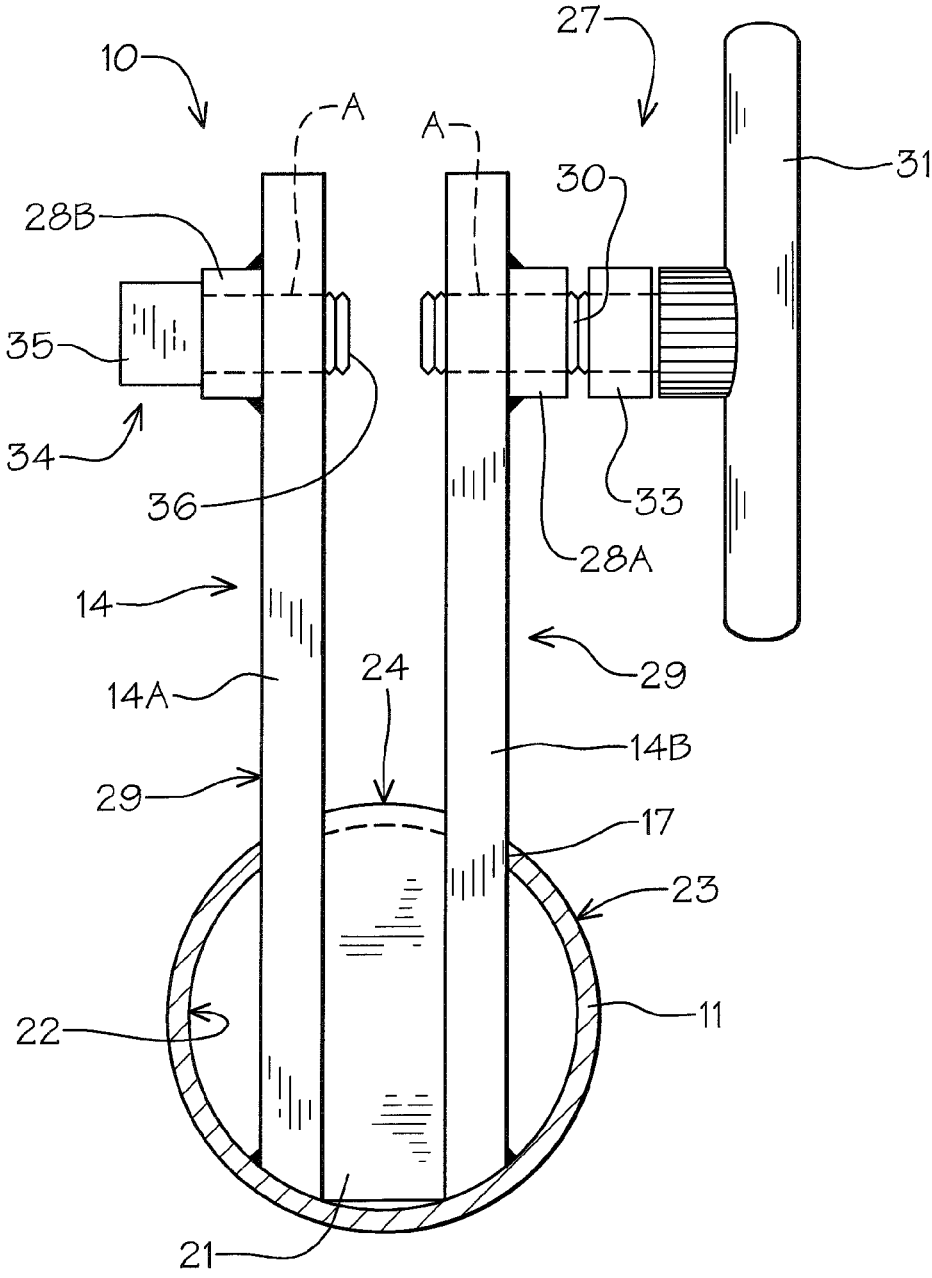
FIG. 3 is an enlarged end view illustrating the attachment bracket configuration.

The positioning of the openings at 17 and 18 in the cylindrical body member 11 are in equal inwardly spaced relation from respective cylindrical body member ends at 19 and 20, best seen in FIGS. 1 and 2 of the drawings. Each of the mounting and quick release attachment fittings 14 and 15 are comprised of a pair of generally rectangular spaced parallel plates 14A, 14B, 15A and 15B respectively. The respective plate pairs 14A, 14B, 15A and 15B are inserted into the cylindrical body member 11 through the respective hereinbefore described openings 17 and 18 as best seen in FIG. 3 of the drawings.

A reinforcement spacer insert 21 is positioned between each of the respective plate pairs and is of a dimension so as to abut both adjacent plate surfaces 14A, 14B, 15A and 15B respectively.

The reinforcement spacer inserts 21 are welded in position to both the interior cylinder surface 22 and the abutting respective plate surfaces of 14A, 14B, 15A and 15B indicated by weld broken lines so designated DL.

The respective reinforcement insert spacers 21 extend to a point as to be proportionally flush with the outer radius surface 23 of the cylinder at 24. Each of the respective plate pairs 14A, 14B, 15A and 15B have aligned apertures A therewithin for receiving a threaded manual blade engagement fastener assembly 27 in aligned engaged orientation within the apertures A therewithin. The blade engagement fastener assemblies 27 each comprise threaded nuts 28A and 28B welded in place to the respective outside surface 29 aligned over the corresponding apertures A of the respective plates.

A threaded engagement rod 30 having a T-shaped activation handle 31 on one end thereof and a contoured blade impingement end surface 32 on the other end is threadably secured through the threaded nuts 28A on the respective plates 14B and 15B. A lock nut 33 provides selective rotation locking of the threaded engagement rod 30 once manually advanced by the T-shaped activation handle 31 during use.

A counter engagement fitting assembly 34 is threadably secured through the corresponding apertures A in the plate pairs 14A and 15A. The counter engagement fitting 34 comprises a square head threaded bolt 35 with a lock nut 36 thereon. The bolt 35 has a contoured blade impingement end surface 36 which as assembled is in spaced effacing relation to said adjustable thread rod 31 impingement end surface 32. Accordingly, the hereinbefore described T-shaped activation handle assemblies 27 can be selectively advanced and therefore engaging the rod's impingement end surface 32 on a configuration of the blade plow BP indicated in broken lines at 37 onto which it is attached as will be well understood by those skilled in the art and illustrated graphically in FIG. 4 of the drawings.

It will be evident from the above description that the plow edge attachment 10 is adapted to variable plow edge configurations and will provide a surface engagement radius so as to prevent unwanted damage to the engaged surface and to the plow blade during use.

It will be obvious to those skilled in the art that different attachment length and even angular inclinations may be adapted to match user plow edges while still providing the improved features of the edge attachment thereto.

It will thus be seen that a new and novel blade attachment for plows and the like has been illustrated and described and it will be apparent to those skilled in the art that various changes and modifications may be made therein without departing from the spirit of the invention.

Therefore I claim:

1. An attachment for a plow blade comprising, a cylinder body member to be coupled to said plow blade between said plow blade edge and a surface to be plowed, a pair of equilateral openings in said cylinder body member, pairs of longitudinally spaced upstanding brackets extending from within said cylinder through said equilateral openings, said brackets comprising, parallel spacer platers secured within said cylinder body member, a reinforcement spacer plate between respective plate portions within said cylinder, blade engagement threaded fasteners extending through said brackets for securing said brackets and cylinder body member to said plow blade.

2. The attachment for a plow blade set forth in claim 1 wherein said blade engagement threaded fasteners through said brackets comprises, a threaded rod, a handle on one end of said rod, an oppositely disposed contoured blade engagement end through one of said brackets, a lock nut on said threaded rod between said handle and said brackets.

3. The attachment for a plow blade set forth in claim 2 wherein said threaded blade attachment fasteners on said brackets further comprises, a counter engagement fitting on one of said remaining brackets comprises, a bolt threadably secured through one of said brackets, a nut on said bolt secured to said bracket and a contoured blade impingement end surface on said bolt aligned with said rod.

4. The attachment for a plow blade set forth in claim 1 wherein said cylinder body member has a contacting region positioned for contacting a surface to be plowed in oppositely disposed relation to said upstanding brackets extending through said openings in said cylinder, said openings in spaced longitudinal relation to one another and in control transversely in said cylinder for receiving said spaced parallel pairs of brackets and reinforcement inserts therein therethrough.

5. The attachment for a plow blade set forth in claim 1 wherein said pairs of upstanding brackets and said reinforcement spacer plates within said cylinder are welded to one another and said cylinder.

* * * * *